US007098583B2

(12) United States Patent
Hideshima et al.

(10) Patent No.: US 7,098,583 B2
(45) Date of Patent: Aug. 29, 2006

(54) SHADOW MASK FOR CATHODE RAY TUBE

(75) Inventors: Hirofumi Hideshima, Tokyo-to (JP); Toshihiro Hatori, Tokyo-to (JP); Akira Makita, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 183 days.

(21) Appl. No.: 10/416,133

(22) PCT Filed: Nov. 12, 2001

(86) PCT No.: PCT/JP01/09876

§ 371 (c)(1),
(2), (4) Date: May 8, 2003

(87) PCT Pub. No.: WO02/39478

PCT Pub. Date: May 16, 2002

(65) Prior Publication Data

US 2004/0027044 A1 Feb. 12, 2004

(30) Foreign Application Priority Data

| | | |
|---|---|---|
| Nov. 10, 2000 | (JP) | 2000-344281 |
| Nov. 10, 2000 | (JP) | 2000-344282 |
| Nov. 17, 2000 | (JP) | 2000-351755 |
| Nov. 17, 2000 | (JP) | 2000-351756 |

(51) Int. Cl.
*H01J 29/70* (2006.01)

(52) U.S. Cl. ..... 313/403

(58) Field of Classification Search ..... 313/402, 313/403

See application file for complete search history.

(56) References Cited

U.S. PATENT DOCUMENTS

| | | | | |
|---|---|---|---|---|
| 4,864,188 | A * | 9/1989 | Sugai et al. | 313/402 |
| 6,437,496 | B1 * | 8/2002 | Kim et al. | 313/402 |

FOREIGN PATENT DOCUMENTS

| | | |
|---|---|---|
| JP | 2-78134 | 3/1990 |
| JP | 0123753 | 4/2000 |
| JP | 0043808 | 2/2001 |
| JP | 0084918 | 3/2001 |
| JP | 0185048 | 7/2001 |
| JP | 0312976 | 11/2001 |

* cited by examiner

*Primary Examiner*—Ashok Patel
(74) *Attorney, Agent, or Firm*—Ladas & Parry LLP

(57) ABSTRACT

A slot tension-type shadow mask for the cathode-ray tube (CRT) has slots. Each slot has two openings and a pseudo-bridge between the two opening of the slot. The slots are formed in the X-Y plane that is formed away from the electron gun in the Z-axis. Each pseudo bridge has a pair of protuberances separated by a lacuna. The edges of each protuberance is etched to have various surface profiles in the X, Y, Z directions and/or the shape of the lacuna is also varied to provide effective shielding while overcoming various problems associated with heating and image imperfections appearing on the CRT screen.

10 Claims, 12 Drawing Sheets

SHADOW MASK FOR CATHODE RAY TUBE

TECHNICAL FIELD

This invention relates to the tension-type shadow mask for cathode-ray tube.

RELATED ARTS

Generally, a cathode-ray tube (CRT) aims and shoots beams of electrons to three-color phosphor targets that glow to produce colors on the CRT screen. For each color of phosphor, a separate gun is used to shoot electron beam. A shadow mask is used in a cathode-ray tube to ensure that the electrons from each gun strike the intended phosphor. That is, the shadow mask is constructed to ensure that electron beam from one gun will strike the correct phosphor dot, but the other two phosphors will be in shadow. This allows the intensity of blue, green, and red colors be controlled separately at each dot location.

Two types of shadow masks are known: the press type and the tension type. Particularly, there have been growing needs for one-dimensional tension type shadow mask, largely to meet requirements of the flat screen cathode-ray tube.

The aperture grill type and the slot tension type are two known one-dimensional tension type shadow mask. The aperture grill type uses a steel plate, which has vertical slit holes formed by applying an etching process to the metallic film so as to form the slit holes in a desired shape. The steel plate is attached to the upper and lower steel frames for providing relatively high tension. The slot tension type uses a steel plate, which has the same rectangular holes (slots) like those present in the press type. The steel plate of the slot tension type shadow mask is attached to the upper and lower steel frames for providing relatively weak tension.

However, the steel plate in the shadow mask of the slot tension type may expand due to heat, and this contributes to the problems of the electron beam mislanding at peripheral parts of the slot of the shadow mask along the X-axis (or for example in the horizontal direction). This is because, the tension is not applied in the X-axis direction, and the bridges that exist at the upper and the lower sides of each slot are expanded by the heat. The position in the X-axis direction is varied by a large amount by virtue of the cumulated expansions. Therefore, material with a low thermal expansion coefficient is required to minimize the thermal expansion; however, other ways to improve the structure has been sought because the material having a low thermal expansion coefficient is known to be expensive.

To solve the above problem, one method proposes to decrease the number of bridges in each slot, i.e., each slot is made so as to be slender in the Y-axis direction (e.g., vertical direction) of the shadow mask. However, if the number of the bridges is reduced in this way, the position of the bridge makes a line on the screen when installing and using the shadow mask in the cathode-ray tube, and the line is taken by the naked eye as a visual obstacle.

To solve the above problems, the pseudo-bridge technique has been proposed. In FIG. 4, a predetermined number of openings 1 in each slot are joined by pseudo-bridges 4. The slots having the openings 1 are then separated by normal bridges 5. Unlike the normal bridge 5, each of the pseudo-bridges 4 is made up of a lacuna 3 formed in between two protuberances 2,2. The lacuna 3 connects two slot openings 1 in the Y-axis direction. The protuberances 2,2 protrude in the direction of X-axis and are separated by a lacuna 3. The amount of electron beam passing through the pseudo-bridge 4 is set in a similar level with that of the normal bridge 5, and thus the shadows of bridges are formed at a distance of 0.5–1.0 mm which effectively prevents visual obstacles, as this is also the case with an ordinary slot type cathode-ray tube. Since the pseudo-bridge 4 has the lacuna 3, it does not expand in the X-axis direction even when heated, Thus, it gives an effect similar to the case of providing slots which are elongated in the direction of the Y-axis of the shadow mask.

Even in the case of utilizing the pseudo-bridges problems still remain, such as the degradation of the color purity by diffused reflection of the electron beam, the incompleteness of the shielding effect to the electron beam near the pseudo-bridge. Further, the problem of brightness change due to the electron beam shift is also present.

SUMMARY OF THE INVENTION

Therefore, a purpose of this invention is to provide an improved shadow mask for the cathode-ray tube.

Also, another purpose of this invention is to provide a shadow mask for the cathode-ray tube which does not give the degradation of the color purity by the diffused reflection of the electron beam even when the pseudo-bridges are formed in the slot tension-type shadow mask.

Moreover, another purpose of this invention is, with respect to the tension slot type shadow mask provided with pseudo-bridges, to provide what has an improved shielding effect to the electron beam at the pseudo-bridges in the periphery edge parts in the Y-axis direction of the mask.

Still another purpose of this invention is, with respect to the tension slot type shadow mask provided with pseudo-bridges, to provide what has an improved shielding effect to the electron beam at the pseudo-bridges in the periphery edge parts in the X-axis direction of the mask.

Moreover, the purpose of this invention is to provide a shadow mask where protuberances of the pseudo-bridges on the panel retain their open-ends rectangularly, and which may decrease the probability of brightness change due to the shift of electron beam.

The first embodiment according to this invention which can achieve the above purposes is a slot tension-type shadow mask for the cathode-ray tube, which is characterized by the fact that slots in the mask are provided individually with a pseudo-bridge which consists of protuberances and a lacuna between them, wherein the protuberances protrude toward the center of the slot in the direction of X-axis of the mask from either side of the slot along the Y-axis direction of the mask; and in at least a part of the slots, each protuberance of the pseudo-bridge is provided with a deviation in the Y-axis direction, wherein the deviation in the Y-axis direction means a condition that, in the relation between the width of the etching part at the mask outer peripheral edge part side (outside etching part) in the Y-axis direction and the width of the etching part at the mask center part side (inside etching part) in Y-axis direction on the surface facing to a screen (being opposite in direction to an electron gun), the inside etching part is longer than the outside etching part, the outside etching part being a part between an endmost point of the protuberance at the mask outer peripheral side in the Y-axis direction and a surface edge point of the protuberance at the outer peripheral side in the Y-axis direction on the surface facing to the screen, whereas the inside etching part being a part between another endmost point of the protuberance at the mask center side in the Y-axis direction and another surface edge point of the protuberance at the mask center side in the Y-axis direction on the surface facing to the screen.

According to this invention, since the pseudo-bridges are provided with the deviation in the Y-axis direction, even at the outer peripheral side in the Y-axis direction of the shadow mask, the side being where the incidence angle of the electron beam becomes larger, the diffused reflection will not occur when the electron beam irradiates to the protuberance of the pseudo-bridge. Therefore, the degradation of the color purity which depends on and is caused by the diffused reflection of the electron beam can be prevented.

In this invention, it is preferable that the pseudo-bridges in the slots located at the outer peripheral side in the Y-axis direction of the shadow mask are provided with the deviation in the Y-axis direction.

Further, in this invention, it is preferable that the width of the lacuna of the pseudo-bridge at the outer peripheral side edge on the surface facing to the electron gun becomes wider than that at the mask center side edge, at a rate of 10%–100%.

When the lacuna is formed in the pseudo-bridge provided with the deviation in the Y-axis direction, at the side formed the deviation, i.e., the mask center side, the etching for providing the lacuna is easy to progress, because the thickness of the steel plate decreases under the influence of the deviation. On the other hands, at the outer peripheral side, the formation of lacuna becomes difficult comparatively, because the steel plate is thick owing to a meager influence of the deviation. Therefore, when the etching is performed equally on both sides, there is a possibility that a problem that the lacuna at the outer peripheral side is not formed at the side of may occur. Thus, by designing the width of the lacuna of the pseudo-bridge at the outer peripheral side edge on the surface facing to the electron gun so as to be wider than that at the mask center side edge at a rate of 10%–100%, the above mentioned problem would be precluded.

The second embodiment according to this invention which achieves the above purposes is a slot tension-type shadow mask for the cathode-ray tube, which is characterized by the fact that slots in the mask are provided individually with a pseudo-bridge which consists of protuberances and a lacuna between them, wherein the protuberances protrude toward the center of the slot in the direction of X-axis of the mask from either side of the slot along the Y-axis direction of the mask; and the inside etching part of the protuberance at the mask center side in the Y-axis direction and facing to the screen has a shape satisfying the relationship:

$$\beta < t1 \times \tan \alpha$$

wherein $\beta$ is the distance of from the outer peripheral side edge of the inside etching part in the Y-axis direction to the mask center side edge of the protuberance, t1 is the thickness of from the mask center side edge of the protuberance to the surface facing to the screen, and $\alpha$ is the incidence angle of the electron beam to the pseudo-bridge, wherein the incidence angle $\alpha$ is the angle with the Z-axis when the electron beam project its locus on the plane including the Y-axis and Z-axis.

In the second embodiment of this invention, since the protuberance of the pseudo-bridge is made the shape which satisfies the above relationship, the electron beam passing through the protuberance of the pseudo-bridge is obstructed around the outer peripheral edge of the inside etching part in the Y-axis direction. Thus, it is possible to decrease the quantity of electron beam passed through the pseudo-bridge, and a shielding area which is similar with that of the regular bridge can be secured.

The third embodiment according to this invention which achieves the above purposes is a slot tension-type shadow mask for the cathode-ray tube, which is characterized by the fact that slots in the mask are provided individually with a pseudo-bridge which consists of protuberances and a lacuna between them, wherein the protuberances protrude toward the center of the slot in the direction of X-axis of the mask from either side of the slot along the Y-axis direction of the mask; and the width of the pseudo-bridge in the Y-axis direction is wider than the width of the normal bridge in the Y-axis direction at a rate of 20%–150%.

The quantity of electron beam which passes near the pseudo-bridge can be reduced as a whole by taking the width of the pseudo-bridge in the Y-axis direction widely, even when the lacuna is formed to a larger size in some degree, and thus, the visual obstacle with the shadow of the normal bridge can be sufficiently prevented.

Similarly, in the second embodiment as mentioned above, it is preferable that the width of the pseudo-bridge in the Y-axis direction is wider than the width of the normal bridge in the Y-axis direction at a rate of 20%–150%. It is because the shielding effect to the electron beam near the pseudo-bridge can be more improved by combining the features of both of the second embodiment and third embodiment in this way.

The fourth embodiment according to this invention which achieves the above purposes is a slot tension-type shadow mask for the cathode-ray tube, which is characterized by the fact that slots in the mask are provided individually with a pseudo-bridge which consists of protuberances and a lacuna between them, wherein the protuberances protrude toward the center of the slot in the direction of X-axis of the mask from either side of the slot along the Y-axis direction of the mask; and the pseudo-bridge formed in each slot has a distance $\delta$ satisfying the relationship:

$$\delta < t2 \times \tan \gamma$$

wherein $\delta$ is the distance in the X-axis direction between the outer peripheral side edge of the etching part on the surface facing to the screen in the X-axis direction of the mask and the peripheral side edge of the lacuna of the pseudo-bridge in the X-axis direction, t2 is the thickness between the outer peripheral side edge of the lacuna of the protuberance and the mask surface facing to the screen, and y is the incidence angle of the electron beam to the pseudo-bridge, wherein the incidence angle $\gamma$ is the angle with the Z-axis when the electron beam project its locus on the plane including the X-axis and Z-axis.

In the fourth embodiment of this invention, since the pseudo-bridge is made the shape which satisfies the above relationship, the electron beam passing through the lacuna of the pseudo-bridge is obstructed at the edge of the side opposite to the mask center in the etching part on the mask surface. Thus, it is possible to decrease the quantity of electron beam passed through the lacuna of the pseudo-bridge, and a shadow which has a similar level with that of the regular bridge can be can be reflected onto the panel. The problem that the position of the regular bridge is taken by the naked eye as the line on the screen as a visual obstacle can be prevented by this fact.

Moreover, in the fourth embodiment of this invention, it is preferable that the $\delta$ which satisfies the above relationship is formed in pseudo-bridges located at positions where the γ is not less than 10°. In the region where the γ is less than 10°, i.e., the region near the center in the X-axis direction, the δ should be set to a particularly small value when satisfying the above relationship, and thus there is a possibility that the problem of difficulties in the processing may arise.

The fifth embodiment according to this invention which achieves the above purposes is a slot tension-type shadow mask for the cathode-ray tube, which is characterized by the fact that slots in the mask are provided individually with a pseudo-bridge which consists of protuberances and a lacuna between them, wherein the protuberances protrude toward the center of the slot in the direction of X-axis of the mask from either side of the slot along the Y-axis direction of the mask; and the lacuna has a shape where the width of the lacuna at the middle part of the lacuna is wider than that at end part of the lacuna.

In the fifth embodiment of this invention, since the shape of the lacuna is prepared so that the width of the lacuna at the middle part of the lacuna is wider than that at end part of the lacuna, the shadow of the protuberance of the pseudo-bridge can be an almost rectangular appearance on the panel, and thus, the possibility of the brightness change on the somewhat shifting of electron beam can be expelled considerably.

In the fifth embodiment of this invention, it is preferable that the width of the lacuna at the end part is a 50%–90% width at the middle part. It is because the shadow of protuberance in the pseudo-bridge formed on the panel can form a rectangular appearance when taking the width of the middle part of the lacuna widely, and taking the width of the end part of the lacuna narrowly within this range.

Moreover, in the fifth embodiment of this invention, when forming the above lacuna, it is desirable to use a photomask of diamond or elliptical shape. Because, by using such photomask, the lacuna in the pseudo-bridge which gives the shadow of the protuberance on the panel a rectangular appearance can be prepared.

Also in the first embodiment of this invention, it is preferable that the lacuna has a shape where the width of the lacuna at the middle part of the lacuna is wider than that at end part of the lacuna.

It is because the degradation of the color purity which is caused by the diffused reflection of the electron beam can be more efficiently prevented by combining the features of both of the first embodiment and fifth embodiment in this way.

BEST MODE FOR CARRYING OUT THE INVENTION

Hereinafter, the shadow mask of this invention for a cathode-ray tube is described in detail.

This invention is applied to the slot tension-type shadow mask for a cathode-ray tube.

Figure 5:
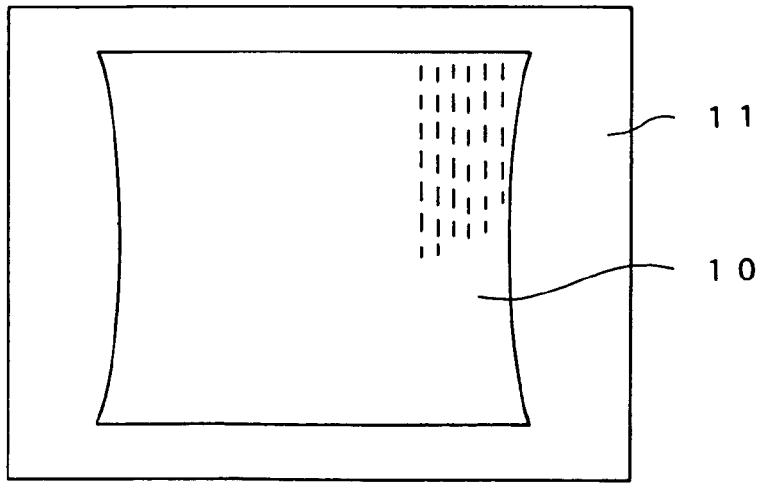
FIG. 5 is a schematic plan view to illustrate the slot tension-type shadow mask.
Figure 6:
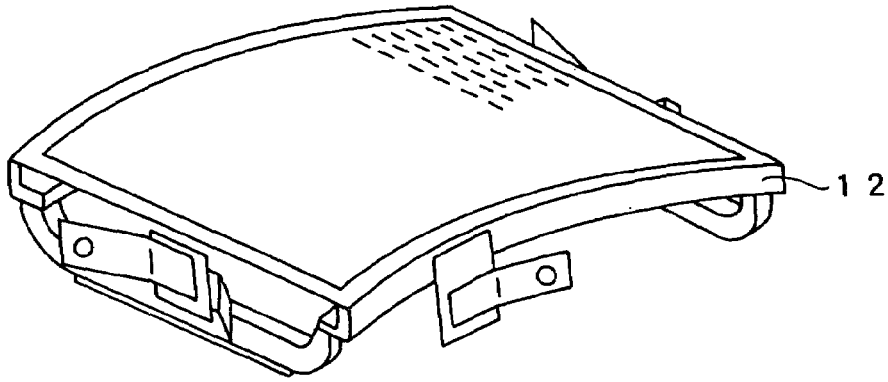
FIG. 6 is a schematic perspective view which shows the assembled condition of the slot tension-type shadow mask.

Here, as shown in FIG. 5, the slot tension-type shadow mask for a cathode-ray tube comprise at least a cathode rays passage part 10 having a lot of minute rectangular holes (that make up the slots) and a skirt part 11. The slot tension-type shadow mask as shown in FIG. 5 is welded under tension to the steel rectangular frame 12 as shown in FIG. 6, and is then detached from its unnecessary part in order to fix it on the predetermined position inside the panel face of the cathode-ray tube. The cathode rays, which are discharged from the electron gun of this cathode-ray tube, pass through the cathode rays passage part 10. The passed cathode rays make the fluorophor in the whole surface panel fluoresce so that an image is displayed on the panel as the aggregate of the minute luminous dots.

The present invention relates to a tension-type shadow mask for a CRT having a slot portion as shown in FIGS. 5–6. The shadow mask is set such that one surface of the shadow mask plate faces to a phosphor screen and the other side surface faces to an electron gun of the CRT.

For a convenience of explanation:

(A) the surface of the shadow mask plate facing the phosphor screen is referred to as the "screen side";

(B) the other side of the surface of the shadow mask plate facing the electron gun of the CRT is referred to as the "electron guns side";

(C) a direction on a plain of the shadow mask to which a tension is applied is referred to as the "Y-axis direction";

(D) a direction crossing Y-axis at right angle on the plain of the shadow mask is referred to as the "X-axis direction"; and (E) a direction vertical to the plain of the shadow mask is referred to as the "Z-axis direction".

Figure 4:
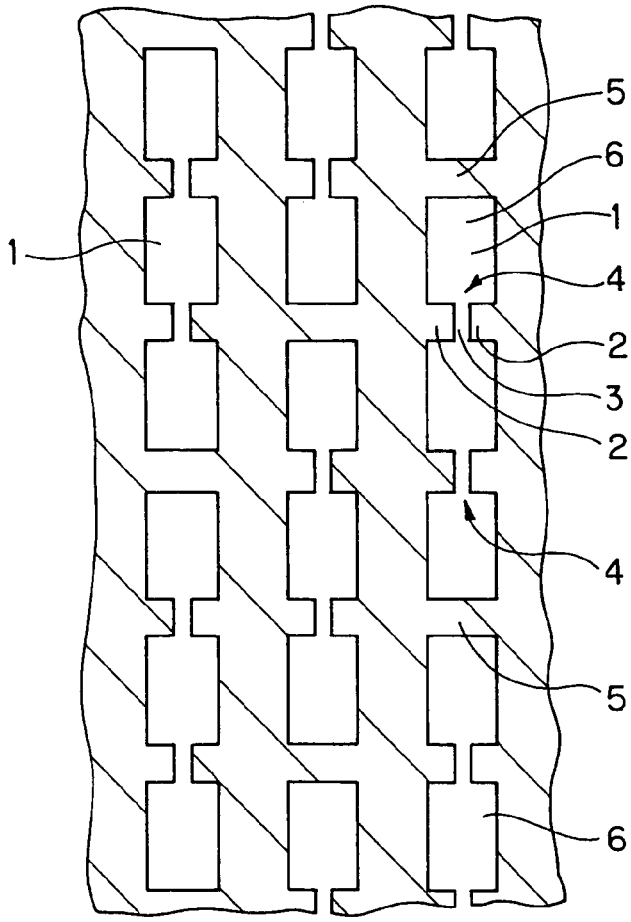
FIG. 4 is a plan view to illustrate the pseudo-bridge.

In the slot portion, there is a lot of slots having nearly rectangular or elliptical shape opening (hole) penetrating through the shadow mask plate in the Z-axis direction. Those slots are arranged in line in the Y-axis direction and arranged in parallel via splits (non-opening row or column) alternatively, in the X-axis direction, as shown in FIG. 4.

Further, for convenience of explanation:

(F) for any pair of openings in each slot positioned adjacently in line in the Y-axis direction, the opening of the slot positioned closer to the shadow mask center in the Y-axis direction is referred to as the "first opening" and (G) the other one of the opening pair of the slot in the Y-axis direction is referred to as the "second opening".

Between any of two slots, the first and the second openings, arranged adjacently in line in the Y-axis direction, there is such portion that remains unopened (not-penetrated) through the mask plate in the Z-axis direction and thus not made to be slot or opening. Such portion not-penetrated in the Z-axis direction located in between the first and the second openings is called a normal bridge 5, as shown in FIG. 4.

In the slot tension-type shadow mask for CRT having a slot portion as mentioned above, certain numbers of pseudo-bridges (or dummy bridges) are provided at portions where the normal bridges would be existed originally.

As shown in FIG. 4, the pseudo-bridge 4 is composed of:

(A) an opening part 1, 1, lacuna 3 penetrating through the mask plate in the Z-axis direction and connecting the first and the second openings with each other as a penetrating hole part of the mask plate, and (B) two protuberance parts 2, 2 existing at both side of the lacuna 3 in the X-axis direction. In other word, two protuberance parts 2, 2 are separated by the lacuna 3 existing in-between then in the X-axis direction.

Figure 12A:
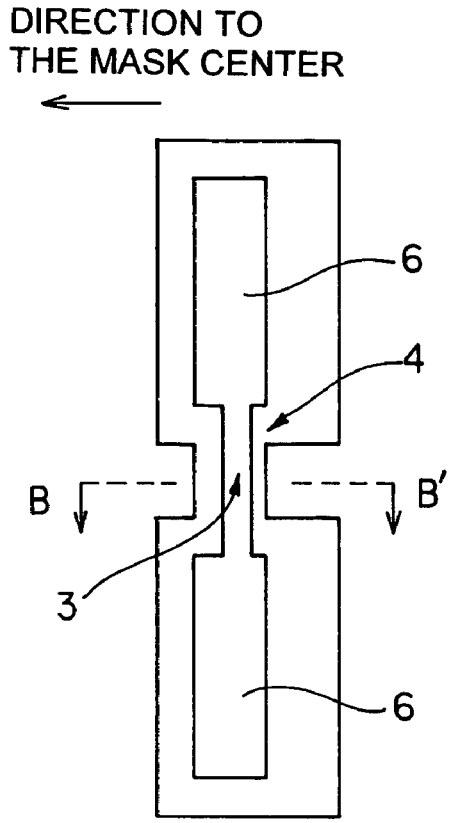
FIGS. 12(*a*)–12(*b*) show an example of the pseudo-bridge in the shadow mask of this invention for the cathode-ray tube, wherein (a) is a plan view and (b) the B–B' arrow sectional view.
Figure 12B:
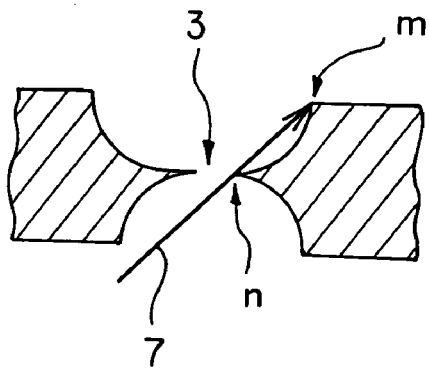

As shown in FIGS. 12(*b*), 13 and 14(*b*)—the invention embodied in this figure is fully described hereinbelow—the slots 1 and the lacuna 3 is formed by etching from both sides of the surface of the mask plate, namely, the screen side and the electron gun side, until two etching parts from both sides of the mask plate meet together to form a penetrating hole (slots 1 and lacuna 3) at the prescribed positions of the shadow mask. In case of the lacuna 3 composing the pseudo-bridge 4, etching is made through the mask plate in the Z-axis direction at nearly middle part of the pseudo-bridge 4. Thus, each protuberance portion 2, 2 extended to the lacuna in the X-axis direction is composed of six-etched portions together with a non-etched portion remaining as an original mask plate surface. The six etched portions have sidewalls of curved slant toward the first and the second openings in the Y-axis direction and a sidewall toward the lacuna in the X-axis direction at both sides of the shadow mask plate, namely, the screen side and the electron gun side, respectively.

It is noted, therefore, that one of the characterizing features of the present invention, among many others, is such specifically designed shapes of the protuberance parts and the lacuna of the pseudo-bridges portion in the slot tension-type shadow mask for CRT comprising a slot portion having pseudo-bridges together with the normal bridges as claimed in the application.

Formation of the Deviation in the Y-Axis Direction

The first embodiment of this invention is directed to pseudo-bridges that have a "deviation" in the Y-axis direction, and this will be fully described in detail below.

As mentioned above with respect to FIG. 4, a pseudo-bridge may consist of protuberances (such as 2, 2) and a lacuna (such as 3) formed between the pseudo-bridges. The pseudo-bridges (such as 4) having the protuberances 2, 2 are formed between the individual openings of a slot (such as 1).

To form a deviation in a pseudo-bridge according to an embodiment of the present invention, means to form a deviation in the Y-axis direction to each protuberance of the pseudo-bridge.

The Y-axis direction of the shadow mask referred throughout this application refers to the direction to which the tension is applied to the shadow mask and that would correspond to the longitudinal direction on (or on a plane that is parallel to) the face of the shadow mask having the slots. The X-axis direction used herein is also on or parallel to the face of the shadow mask and is in the direction substantially perpendicular to the Y-axis (that is in the direction to which the tension is not applied). The Z-axis direction is perpendicular to both the X and Y axes and is the direction vertical to the shadow mask face. For example, an electron beam may travel along the Z-axis direction to hit the slot in a particular X and Y axes location on the CRT screen.

According to the prior art, when a pseudo-bridges were formed to connect any two openings in each slot, particularly for those slots formed at the outer peripheral region in the Y-axis direction of the face of the shadow mask, problems exist in the form of diffused reflection off the protuberances (2,2 as in FIG. 4) of the pseudo-bridge. This causes bad influence on the images produced on the cathode-ray tube. Overcoming these prior art problems will now be explained in detail with reference to FIGS. 3(*a*)–3(*b*).

Figure 3A:
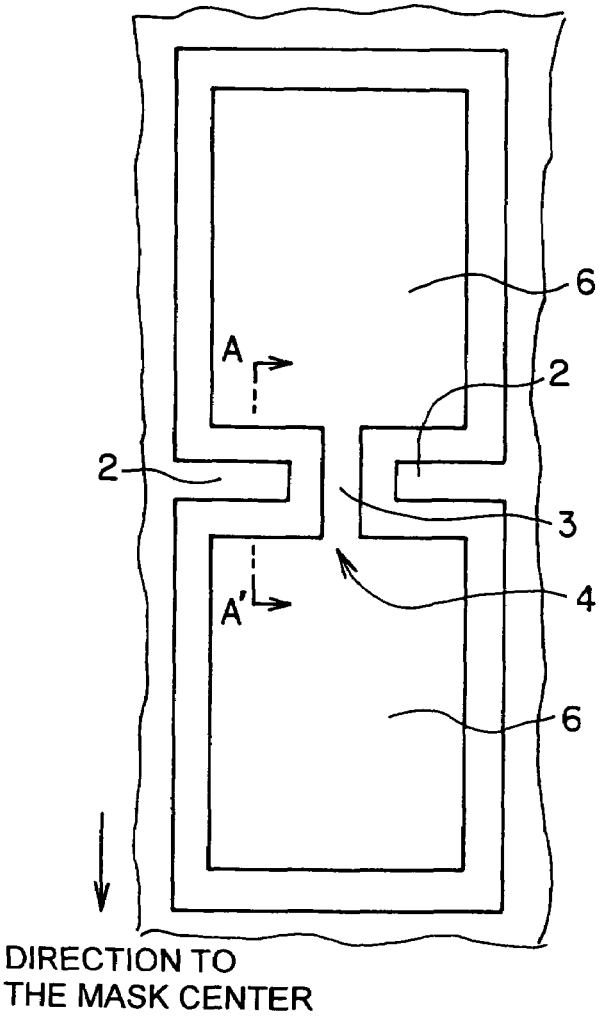
FIGS. 3(*a*)–3(*b*) illustrate an example of the pseudo-bridge in the shadow mask for the cathode-ray tube, wherein (a) is a plan view and (b) the A–A' arrow sectional view.
Figure 3B:
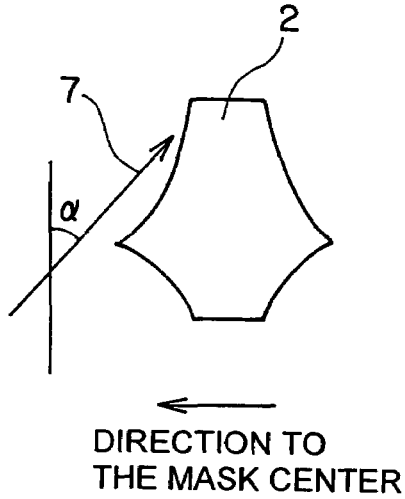

FIG. 3(*a*) shows a slot having two openings 6A, 6B, and a pseudo-bridge 4 which are formed between the openings 6A, 6B. As shown, the pseudo bridge 4 consists of two protuberances 2, 2 and a lacuna 3 between the protuberances 2, 2. FIG. 3(*a*) is a plan view seen from the side opposite to the electron gun side, i.e., from the screen side. That is, FIG. 3(*a*) is a view shown along the plane formed by X and Y axes. Further, FIG. 3(*b*) shows the cross section view along the line indicated with A–A' arrow in FIG. 3(*a*). That is, FIG. 3(*b*) shows the view along the Z-axis. When this slot shown in FIG. 3(*a*) is situated on a relatively outer peripheral region in the Y-axis direction of the shadow mask (that is, farther away from the electron gun in the Y-axis direction), the incidence angle $\alpha$ of the electron beam 7 becomes a relatively larger value than when the slot is situated relatively on the inner portion of the shadow mask nearer to the electron gun. When the incidence angle $\alpha$ is a relatively large value, the electron beam 7 entering the area in the opening 6A is shielded by the protuberance 2, 2 of pseudo-bridge 4 as shown in FIG. 3(*b*). The shielded electron beam 7 hitting the protuberance 2 is reflected diffusely and causes bad influence on the image created by the cathode-ray tube as the result.

However, the shadow mask according to various embodiments of the present invention eliminates the occurrence of such prior art problems by providing a deviation in the Y-axis direction to the pseudo-bridge.

Now, the shadow mask of various embodiments of this invention is described with reference to the drawings.

Figure 1A:
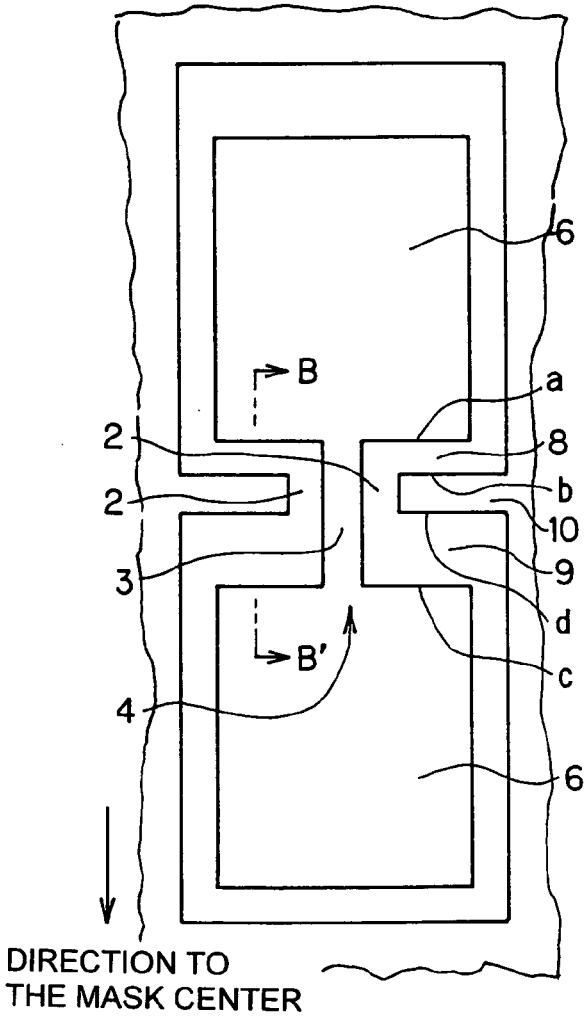
FIGS. 1(*a*)–1(*b*) illustrate an example of the pseudo-bridge in the shadow mask of this invention for the cathode-ray tube, wherein (a) is a plan view and (b) the B–B' arrow sectional view.
Figure 1B:
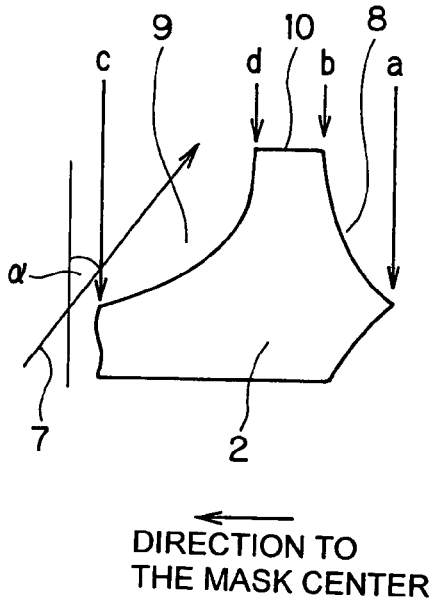

FIG. 1(*a*) is a plan view which shows the slot part of the shadow mask according an embodiment of this invention when viewed from the screen side of the CRT having the shadow mask, and FIG. 1(*b*) is the sectional view taken along the line B–B' shown with arrows in FIG. 1(*a*). Throughout this application, the X, Y, Z reference directions are same as above described with respect to FIGS. 3(*a*)–3(*b*). In this embodiment, the pseudo-bridge 4 having two protuberances 2, 2 and a lacuna 3 formed between them, and the pseudo-bride 4 is formed between two openings 6. As described above, this invention is characterized by a deviation formed in the Y-axis direction at the protuberances 2, 2 of the pseudo-bridge 4.

To form a deviation in the Y-axis direction at the protuberances 2 of the pseudo-bridge 4 means to form the pseudo-bridge 4 so as to satisfy the condition that the width of an inside etching part 9 as shown in FIGS. 1(*a*)–1(*b*) as the distance between points c and d is longer than the width of an outside etching part 8 as also shown in FIGS. 1(*a*)–1(*b*) as the distance between points a and b. More specifically, the width a to b of the etching part 8 is located at the mask outer peripheral edge part side (outside etching part) in the Y-axis direction, that is, the width a to b of the etching part 8 is located farther away from the electron beam source or the mask center than the width c to b of the etching part 9 at the mask center part side (inside etching part) in Y-axis direction. Therefore, the width c to d of the inside etching part 9 (as shown in FIG. 1(*b*)) is longer than width a to b of the outside etching part 8. As shown in the cross sectional view of FIG. 1(*b*), the protuberance 2 has a portion 10 having a width b to d that is facing the screen. The outside and inside etching parts 9, 8 do not face the screen as the curved etching shape is shown in FIG. 1(*b*). The outside etching part 8 is a part between an endmost point a of the protuberance 2 at the mask outer peripheral side in the Y-axis direction and a surface edge point b of the protuberance 2 at the outer peripheral side in the Y-axis direction on the surface 10 facing to the screen. The inside etching part 9 is a part between another endmost point c of the protuberance 2 at the mask center side in the Y-axis direction and another surface edge point d of the protuberance 2 at the mask center side in the Y-axis direction on the surface 10 facing to the screen.

Since the deviation in the Y-axis direction is formed to the protuberance 2 in the pseudo-bridge 4 (as shown by etching the parts 8, 9 in FIG. 1(*b*)), even at a slot located at the outer peripheral region in the Y-axis direction of the shadow mask (that is, this where the incidence angle $\alpha$ of the electron beam 7 becomes larger than incidence angle of the slot located near the inner portion of the shadow mask toward the location of the electron beam gun), the electron beam can pass through openings of the slot in the shadow mask without being subjected to shielding (by, for example, the protuberance 2 having no deviation of the width c to d as shown in FIG. 1(*b*)), and thus the diffused reflection will not occur. Therefore, The problem for the degradation of the color purity cannot come up according to this embodiment of the present invention.

In this invention, in general, whenever the pseudo-bridge is located nearer to the outer peripheral edge of the shadow mask in the Y-axis direction, the difference between the width a to b of the outside etching part 8 and the width c to d of the inside etching part 9 will be greater. Further, at about the central part of the shadow mask in the Y-axis direction, the deviation in the Y-axis direction is not formed to the pseudo-bridge. That is, at the central part of the shadow mask in the Y-direction, the difference between the width a to b and the width c to d shown in FIG. 1(*b*) would equal 0.

When forming the deviation in the protuberance 2 in the pseudo-bridge 4, there is a large difference between the thickness of the protuberance 2 at the outside etching part 8 and thickness of the protuberance 2 at the inside etching part 9 as shown in FIG. 1(*b*). More portion of the width c to d of the inside etching part 9 is thinner than width a to b of the outside etching part 8. Thus, when forming the lacuna 3 between two protuberances 2, 2 that are shaped by etching as shown in FIG. 1(*b*), it becomes easier to cut through the inside etching part 9 than the outside etching part 8 to form the lacuna 3.

Figure 2A:
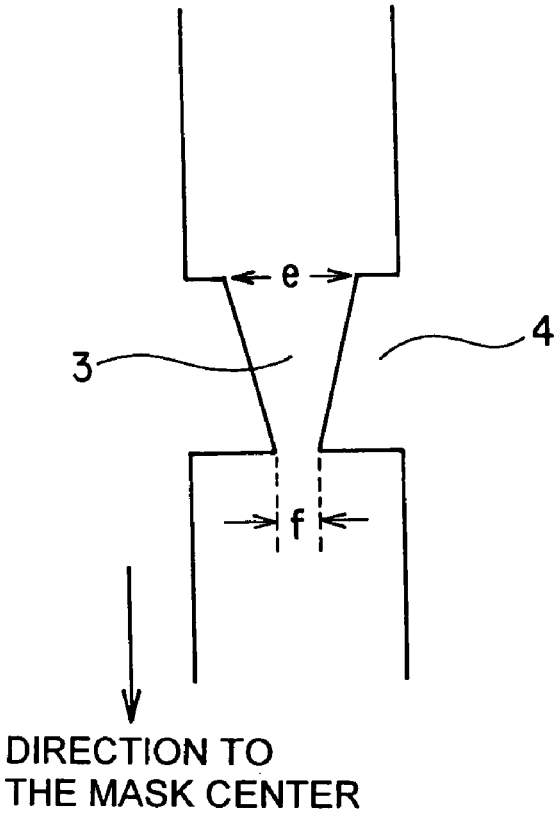
FIGS. 2(*a*)–2(*b*) are schematic plan views which each show the electron gun facing surface of the lacuna of the pseudo-bridge in the shadow mask of this invention for the cathode-ray tube.
Figure 2B:
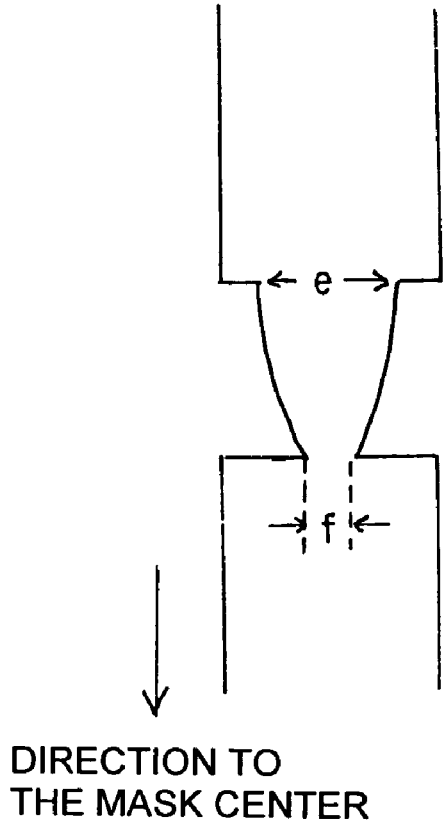

This problem has been solved by the present invention by adjusting the widths of the two ends of lacuna 3 that connects the upper and lower openings 6, 6 of the slot as shown in FIGS. 2(*a*)–2(*b*). It is preferable that the width of the lacuna of the pseudo-bridge which has the deviation in the Y-axis direction is formed so that the width e (which corresponds to the outer peripheral side edge on the surface away from the electron gun such as the width e of the lacuna 3 connecting the upper opening 6) is larger than the width f of the lacuna 3 connecting the lower opening 6 which in turn would be closer to the electron gun along the Y-direction. Since the width e is greater, the etching quantity at the outside etching part 8 can be increased, and this eliminates the problems that the outside etching part 8 may not be cut through due to the thickness when forming the lacuna 3.

FIGS. 2(*a*)–2(*b*) show the shadow mask surface of a slot having two openings separated by the pseudo-bridge having a lacuna 3. In these figures, the electron gun is located below the slot near the location of the mask center. The width e at the outer peripheral edge in the Y-axis direction of the shadow mask (i.e., farther away from the electron gun) is larger than the width f nearer to the shadow mask center.

In this invention, it is desirable that the width e at the outer peripheral side edge (farther away from the shadow mask center) is wider than the width f nearer to the shadow mask center at a rate of 10%–100%, particularly at a rate of 20–30%, and especially preferable at a rate of 20–25%.

With respect to the shape of the lacuna 3 under such a condition, it may be formed so that its width is enlarged rectilinearly from the mask center side to the outer peripheral side as shown in FIG. 2(*a*). Alternatively, it may be curvilinearly as shown in FIG. 2(*b*), or it may be any other shape. As far as the width e of lacuna 3 at the outer peripheral edge in the Y-axis direction is larger than the width f at the mask center edge at the above mentioned rate, the shape of the outline of the lacuna 3 between the edges e and f is not particularly limited to those shown in FIGS. 2(*a*)–2(*b*), and various other shapes are also possible in the same spirit of the present invention as described above and throughout this application.

The Shield of the Incident Beam at the Pseudo-Bridge (Y-Axis)

To improve the shielding effect of the electron beam near the pseudo-bridge, which is provided for the slot of the shadow mask, this invention also provides two other means. Now, these are described as second embodiment and third embodiment.

In order to obtain an effect similar to that of the normal slot for the pseudo-bridge formed in the slot, it is desirable that the quantity of the electron beam passing through the lacuna of a pseudo-bridge in a slot is suppressed as much as possible. As a way of suppressing the quantity of the electron beam passing through a lacuna, a conventional technique proposes narrowing the width of the lacuna, but this technique has its own problematic limitations related to the adverse effect on the etching precision The second embodiment of this invention provides solution to the above problems related to suppressing the quantity of a electron beam passing through a lacuna, and its characteristic is laid on a specified shape of the pseudo-bridges formed in the slots of a shadow mask.

Figure 9A:
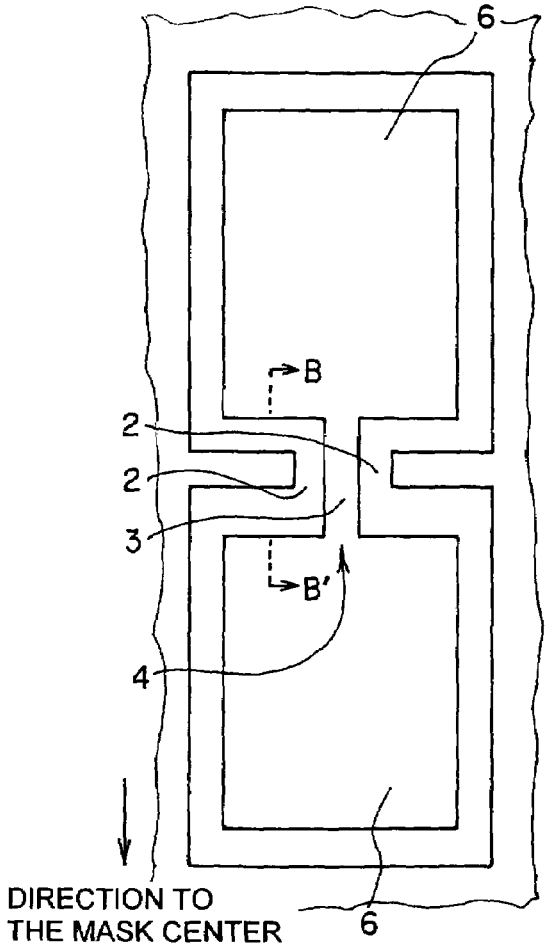
FIGS. 9(*a*)–9(*b*) show an example of the pseudo-bridge in the shadow mask of this invention for the cathode-ray tube, wherein (a) is a plan view and (b) the B–B' arrow sectional view.
Figure 9B:
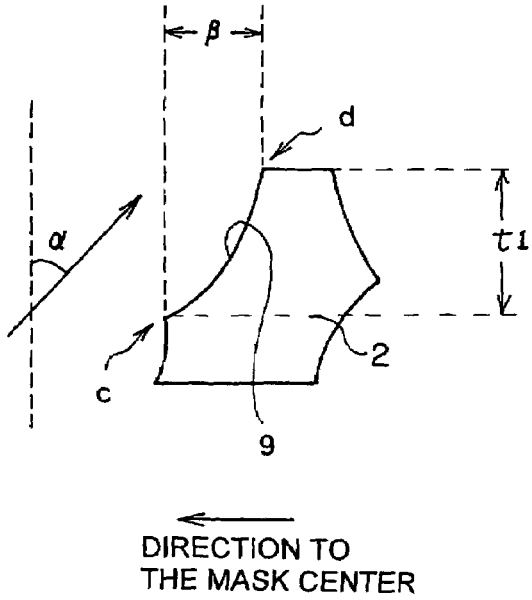

Now, the shape of the pseudo-bridge according to the second embodiment of this invention is described with reference to the drawings. FIG. 9(*a*) is the plan view which shows the slot part of the shadow mask of this invention when viewing from the screen side, and FIG. 9(*b*) is a cross sectional view along the line B–B' shown with arrows in FIG. 9(*a*). As shown in FIGS. 9(*a*)–9(*b*) the pseudo-bridge 4 consists of two protuberances 2, 2 and a lacuna 3 which is formed between the protuberances 2, 2. The lacuna 3 is formed between the two openings 6, 6. The characteristic of this invention is to make the shape of each protuberance 2 of this pseudo-bridge 4 a shape satisfying the following relationship:

$$\beta < t1 \times \tan \alpha$$

In this expression, β is the distance of from the outer peripheral side edge d of the inside etching part 9 in the Y-axis direction to the mask center side edge c of the protuberance 2 as shown in FIG. 9 (*b*). The inside etching part 9 is the etching part in the protuberance 2 on the side closer to the shadow mask center in the Y-axis direction.

Next, t1 is the thickness measured from the above mentioned edge c as shown in FIG. 9(*b*) to the edge d, which is at the screen side surface of the steel plate. The thickness t1 measures the distance in the direction of Z-axis. Further, α is the incidence angle of the electron beam to the pseudo-bridge 4, wherein the incidence angle α is the angle with the Z-axis when the electron beam project its locus on the plane including the Y-axis and Z-axis.

Figure 10:
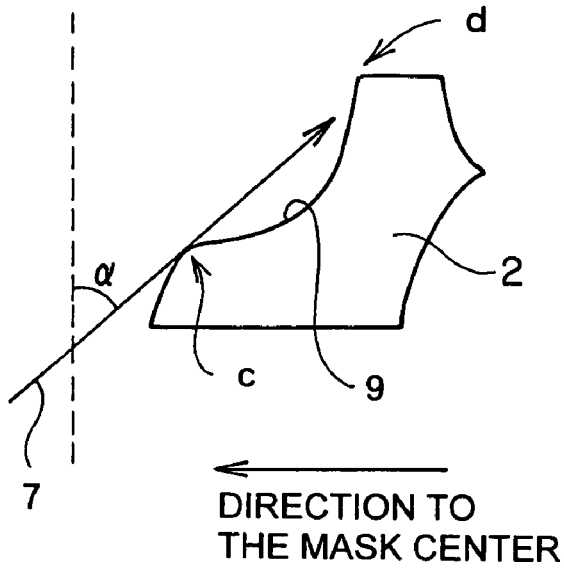
FIG. 10 is a schematic sectional view which shows another example of protuberances of the pseudo-bridge in the shadow mask of this invention for the cathode-ray tube.

As shown in FIG. 10, when the edge part c (i.e., closer to the shadow mask center in the Y-direction) of the protuberance 2 is inaccurate, the position of the edge part c should be determined as follows. Namely, when the incidence angle of the electron beam 7 to the pseudo-bridge 4 that has such protuberance 2 is taken as α, as shown in FIG. 10, the contact point of the straight line which have the angle α with the longitudinal axis on this figure and the mask center side part of the inside etching part 9 is defined as the mask center side edge part c of the protuberance 2.

When the protuberance 2 of the pseudo-bridge is formed so as to satisfy the above relationship, for example, as shown in FIGS. 2(*a*)–2(*b*), at least the electron beam 8 irradiated along the edge c comes to be shielded by the inside etching part 9 closer to the shadow mask center in the Y-axis direction than the edge d of the etching part of the mask surface. Therefore, the quantity of the electron beam which passes near protuberance 2 of pseudo-bridge 4 can be decreased by the quantity of the electron beam which was sheltered as mentioned above. Thereby, the shielding effect of the electron beam at the pseudo-bridge is improved, and the visual obstacle where the normal bridges are emphasized and the horizontal black strips are observed can be prevented more effectively by the pseudo-bridge.

The above-mentioned relationship of this invention can be applied in any area except at the part on the center line of the Y-axis of the shadow mask where α is 0°.

With respect to the thickness of the steel sheet, which is used for the shadow mask of this invention for the cathode-ray tube, a thickness within the range of generally used in this art may be adaptable. For example, a thickness in the range of 80 μm to 150 μm may be used. The above-mentioned t1 generally has a thickness which is half or more than half the thickness of the steel sheet.

Next, the third embodiment according to this invention is described. According to the third embodiment of this invention, the width of the pseudo-bridge (having a lacuna) in the Y-axis direction is wider than the width of the normal bridge (having no lacuna) in the Y-axis direction at a rate of 20%–150%

In order to prevent the horizontal black stripes due to enhancement of the normal bridges (having no lacuna), it is desirable that the pseudo-bridge (having a lacuna and which is used for this invention) has a quantity of electron beam being shielded at a level similar to that being shielded by the normal bridge. However, since the pseudo-bridge has a lacuna at the center part in the X-axis direction thereof, the quantity of the electron beam, which passes through the pseudo-bridge, is larger than that of the normal bridge (having no lacuna) by the quantity of passing through the lacuna in the pseudo-bridge.

In addition to the second embodiment as a method for regulating the passage amount of the electron beam, the third embodiment provides that the "width of the pseudo-bridge in the Y-axis direction" is wider than the "width of the normal bridge in the Y-axis direction" as this will be described in more detail with reference to FIG. 11.

In this invention, the width of the pseudo-bridge in the Y-axis direction is wider than the width of the normal bridge in the Y-axis direction at a rate of 20%–150%, more preferably at a rate of 40%–60%, when the width of the normal bridge in the Y-axis direction is taken as 100%.

Figure 11:
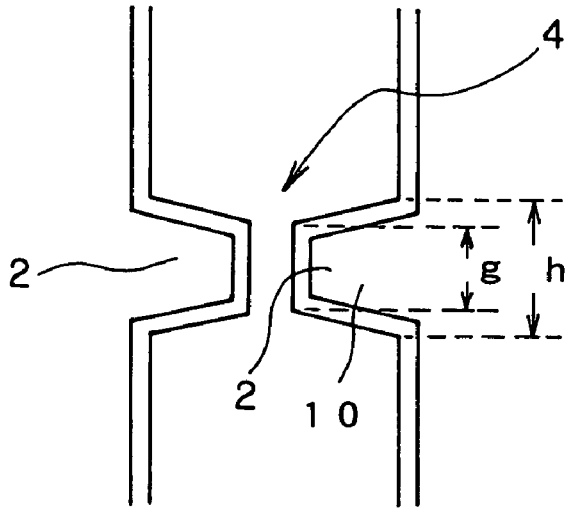
FIG. 11 is a schematic plain view which shows yet another example of the pseudo-bridge in the shadow mask of this invention for the cathode-ray tube.

As shown in FIG. 11, the "width of the pseudo-bridge in the Y-axis direction" according to this embodiment of the invention is determined by measuring the width h of the widest part between the two protuberance 2, 2 of pseudo-bridge 4 in the Y-axis direction and the width g of the narrowest part between the two protuberances 2, 2 of pseudo-bridge 4 in the Y-axis direction, and calculating the mean value of the widths h and g. The widths g and h are obtained by measuring the distance between the both edges of the protuberances 2 in the Y-axis direction, but these widths g and h are not measured at the shadow mask surface 10 where the etching is not performed. FIG. 11 clearly shows the measurements for the widths g and h, and the mean value of the widths g and h is referred to as the "width of the pseudo-bridge in the Y-axis direction."

The "width of the normal bridge in the Y-direction" is also determined by the a similar way where the width of the widest part of the normal bridge in the Y-axis direction and the width of the narrowest part of the normal bridge in the Y-axis direction are measured in order to calculate the mean value of the measured widths as the width of the normal bridge. Incidentally, the normal bridge 5 (shown FIG. 4) separates the slots 1 having openings 6 in the Y-axis direction.

In this invention, it is possible to combine the features of the second embodiment with the features of the third embodiment. The combination would be able to effectively preclude the horizontal black stripes forming on the CRT screen. The combination would effectively regulate the amount of the electron beam passing through the pseudo-bridge so that the passing amount is similar to that of the normal bridge.

The Shield of the Incident Beam at the Pseudo-Bridge (X-Axis)

As mentioned above, in order to obtain an effect similar to that of a normal slot by a pseudo-bridge formed in a slot, it is desirable that the quantity of the electron beam passing through the lacuna of the pseudo-bridge should be suppressed as much as possible. As described above, for the openings in a slot that is located away from the electron gun (that is, to the outer peripheral side of the shadow mask) in the Y-axis direction of the shadow mask, a deviation is created in the pseudo bridge of each slot. The shape of the deviation is adaptable or varies according to the position of the slot in the Y-axis direction. For the slots formed in the shadow mask center, the deviation in each slot will allow the electron beam transmitted from a gun at the mask center to pass through the slots of the shadow mask without being subjected to shielding.

Then, when providing such deviation in the X-axis direction to a lacuna 3 in this way (that is, along the X-axis direction at the mask center or at a point along the Y-axis direction at which the electron gun is positioned), a problem would arise that the quantity of the electron beam passing through lacunas of the pseudo-bridges cannot be sufficiently suppressed.

Figure 14A:
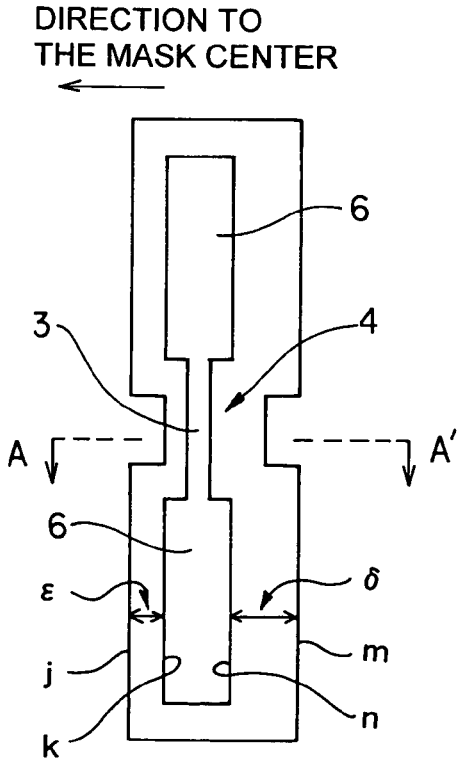
FIGS. 14(*a*)–14(*b*) show an example of the pseudo-bridge in the shadow mask for the cathode-ray tube, wherein (a) is a plan view and (b) the A–A' arrow sectional view.
Figure 14B:
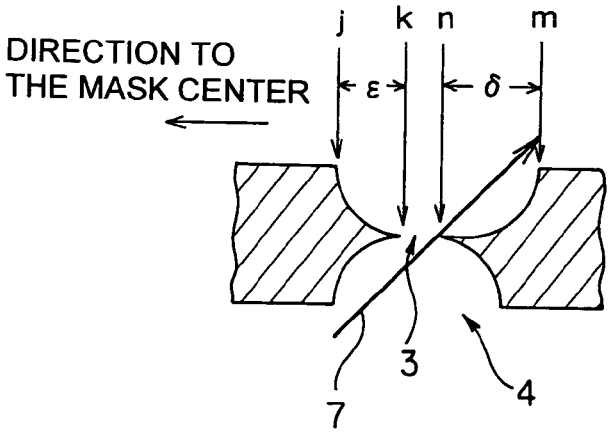

Here, the deviation formed in the X-axis direction according to an embodiment of the present invention is described with reference to FIGS. 14(*a*)–14(*b*). FIG. 14(*a*) shows the plan view of a slot having two openings 6, 6 and a pseudo-bridge 4 formed between the two openings 6. The plan view of FIG. 14(*a*) is seen from the CRT screen side, i.e., from the side opposite to the electron gun side. Further, FIG. 14(*b*) shows the cross sectional view along the line the A–A' shown with arrows in FIG. 14(*a*).

As shown in FIGS. 14(*a*)–14(*b*), the edges surrounding the two openings 6, 6 and the protuberance 4 are formed with deviation as shown in FIG. 14(*b*). As shown in FIG. 14(*a*), the deviation between the points j to k (i.e., positioned closer to the gun in the shadow mask center in the X-axis direction) has a width $\epsilon$, and the deviation between the points n to m having a width $\delta$ is positioned farther away from the gun in the shadow mask center. The width $\delta$ is longer than the width $\epsilon$.

When such a deviation is formed, the electron beam 7, which passes through the lacuna 3 from the mask center as shown in FIG. 14(*b*), passes through the lacuna 3 just as though the beam is without being completely sheltered. With respect to the pseudo-bridge, its effect can be produced until when the quantity of the electron beam (which passes through the lacuna) is sufficiently suppressed, as described above. In this case, therefore, the need for suppression of the width of lacuna 3 is arisen. In general, however, it is often difficult because of the etching precision is required.

More specifically, when giving full scope to the function of a pseudo-bridge, the quantity of electron beam passing through the lacuna 3 having the width (that is, the distance k to n shown in FIG. 14(*b*)) of about 40 μm is desired, but the width of lacuna 3 is generally formed in the range of 50–80 μm in view of the etching precision. Therefore, a special means to reduce the passage amount of the electron beam is needed.

The fourth embodiment of this invention has been contrived under such aspect, and its characteristic is to specify the shape of the pseudo-bridge provided for the slot of the above shadow mask.

Now, the shape of the pseudo-bridge according to this embodiment of the invention is described using the drawings. FIG. 12(*a*) is the plan view which shows a slot having two openings 6, 6 of the shadow mask. FIG. 12(*b*) is the cross section view along the line B–B' in FIG. 12(*a*). As shown in FIGS. 12(*a*)–12(*b*), a pseudo-bridge 4 is formed between two openings 6, 6. At the pseudo-bride 4 of each opening 6, the deviation (as illustrated in FIG. 14) is provided so that the electron beam from the mask center would passe through the pseudo-bridge 4 without being shielded.

The characteristic of this embodiment of the invention is to make the shape of the pseudo-bridge 4 (i.e., the deviation) formed between the openings 6 a shape satisfying the following relationship:

$$\delta < t2 \times \tan \gamma$$

Figure 13:
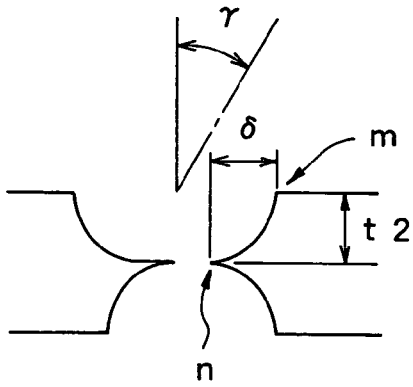
FIG. 13 is a schematic sectional view to illustrate the relationship showing the shape of the pseudo-bridge required in this invention.

In this expression, $\delta$ is, as shown in FIG. 13, the distance in the X-axis direction of from the X-axial outer peripheral side edge m, i.e., the edge in the direction opposite to the mask center side, of the etching part 9 on the steel plate surface at the screen side to the X-axial outer peripheral side edge n, i.e., the edge in the direction opposite to the mask center side, of the lacuna in the pseudo-bridge. And t2 is, as shown in FIG. 13, the thickness of from the above mentioned edge n to the screen side surface of the steel plate, namely, the distance in the direction of Z-axis. Further, $\gamma$ is the incidence angle of the electron beam to the pseudo-bridge 4, wherein the incidence angle $\gamma$ is the angle with the Z-axis when the electron beam project its locus on the plane including the X-axis and Z-axis.

When the pseudo-bridge is formed so as to satisfy the above relationship, as shown in FIG. 12(*b*), at least the electron beam 7 irradiated along the edge n comes to be shielded by parts around the edge m of the etching part of the steel plate surface. Therefore, the quantity of the electron beam which passes pseudo-bridge 4 can be decreased by the quantity of the electron beam which is sheltered at around the edge m of the etching part on the steel plate surface. Therefore, the pseudo-bridge can produce the shade at a similar level with the normal bridge on the panel, and which can prevent the visual obstacle.

It is preferable that the above-mentioned relationship according to this invention is applied to areas where $\gamma$ is not less than 10°, particularly areas where $\gamma$ is not less than 20°, namely, areas of the outer peripheral side in the X-axis direction of the mask. This is because, at the areas where $\gamma$ is less than the above-mentioned range, namely, at the areas of center side in the X-axis direction, the value of $\delta$ calculated may be too small to satisfy the relationship in view of working difficulties.

With respect to the thickness of the steel sheet which is used for the shadow mask of this invention for the cathode-ray tube, a thickness within the range of generally used in this art may be adaptable. Concretely, a thickness in the range of 50 μm to 150 μm may be used. The above mentioned t2 generally has a thickness which is about a half of the thickness of the steel sheet.

The Widen-in-the-Middle Lacuna of the Pseudo-Bridge

Now referring to FIGS. 16(*a*)–16(*b*) and 17(*a*)–17(*b*), the problems related to the pseudo-bridges having the rectangular shape (as shown in FIG. 4) provided to the slots in a shadow mask are described as follows.

Figure 16A:
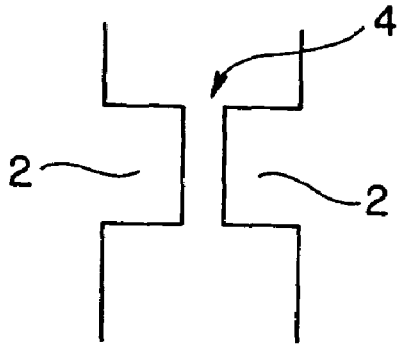
FIG. 16(a) (PRIOR ART)
FIGS. 16(*a*)–16(*b*) show a pseudo-bridge in the conventional shadow mask for the cathode-ray tube, wherein (a) is a plan view and (b) the plan view which shows a shadow of the pseudo-bridge on the panel.
Figure 16B:
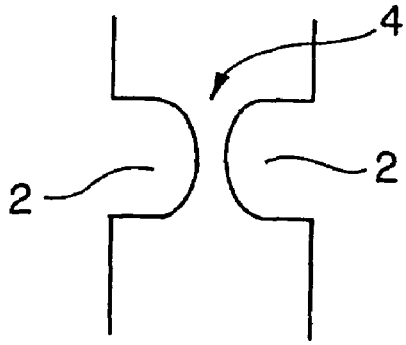
FIG.16(b) (PRIOR ART)
Figure 17A:
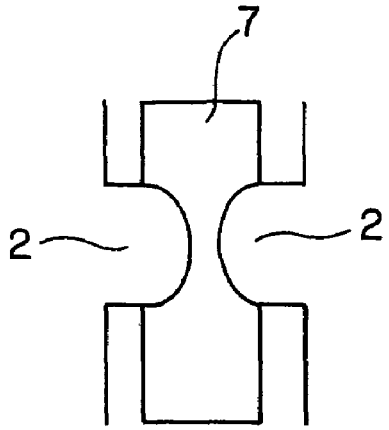
FIG. 17(a) (PRIOR ART)
FIGS. 17(*a*)–17(*b*) show the conditions that the electron beam is irradiated to the shadow of the pseudo-bridge on the panel as shown in FIG. 16(*b*), wherein (a) is a plan view which show the condition that the electron beam is irradiated to the normal site, and (b) a plan view which show the condition that the electron beam is irradiated with a shift.
Figure 17B:
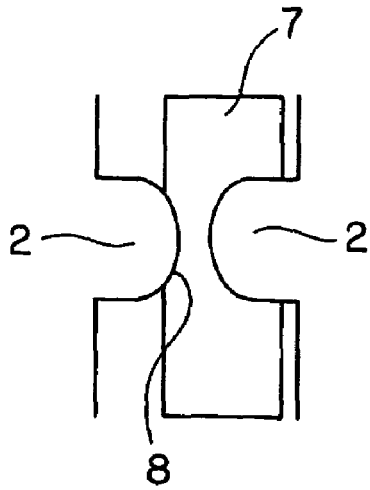
FIG.17(b) (PRIOR ART)

When the protuberances 2, 2 of the pseudo-bridge 4 are shaped rectangular as shown in FIG. 16(*a*), the resulting shape of the shadow for each slot on the CRT panel is round at the edges of the protuberances 2, 2 of pseudo-bridge 4 as shown in FIG. 16(*b*) owing to the wraparound of the light, etc. (i.e., diffraction of light). There will be no problem if the electron beam 7 is aimed correctly to a slot and irradiated on the CRT screen exactly as shown in FIG. 17(*a*) having the rounded edges of the protuberances 2, 2. However, if the electron beam 7 is irradiated with a shift (misregistration) and the boundary part of the beam lies on the round part 8 in the edge of protuberance 2 as shown in FIG. 17(*b*), the brightness of the image for the slot irradiated on the CRT screen is not uniform but varied in proportion to the shift.

Figure 15A:
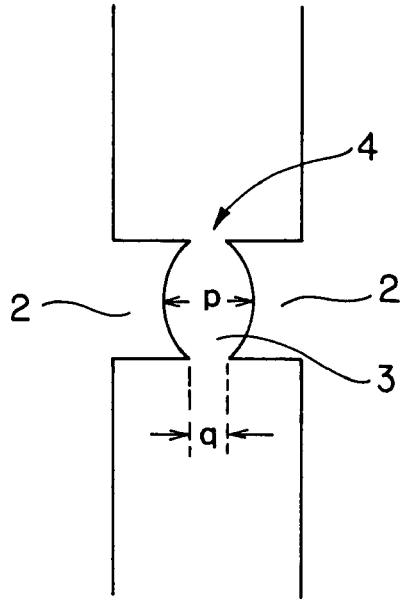
FIGS. 15(*a*)–15(*b*) show an example of the pseudo-bridge in the shadow mask of this invention for the cathode-ray tube, wherein (a) is a plan view and (b) a plan view which shows a shadow of the pseudo-bridge on the panel in the condition that an electron beam is irradiated.
Figure 15B:
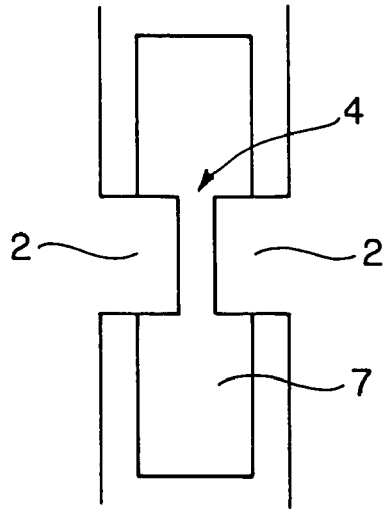

The fifth embodiment of the present invention shown in FIGS. 15(*a*)–15(*b*) solves the above problems. The fifth embodiment of this invention is characterized by the non-rectangular shape of a lacuna in the pseudo-bridge in a slot of a shadow mask as this is shown in FIG. 15(*a*). The shape of a lacuna according to the fifth embodiment of the present invention has a wider width at the middle part of the lacuna (that is, the width p) than the width of either end of the lacuna (that is, the width q) joining the upper or lower opening of the slot. The image of the slot having the rounded protuberances 2, 2 as shown in FIG. 15(*a*) is projected on the CRT screen to have the rectangular shape as shown in FIG. 15(*b*).

The Y-axial length of this pseudo-bridge 2 (that is, the vertical length of the protuberance 2 shown in FIG. 15(*a*)) may have the same length of an ordinary normal bridge. Although it depends on the size, the use, or the like of the cathode-ray tube, the Y-axial length of the pseudo-bridge according to the fifth embodiment is generally in the range of 60 μm–150 μm.

FIG. 15(*a*) shows the pseudo-bridge part of an example of the shadow mask according to the fifth embodiment of this invention. In this embodiment of the invention, the width p of the center is wider than the width q of each end part of the two protuberances 2, 2 of the pseudo-bridge 4.

In this embodiment of the invention, the width q of the end part of the lacuna is preferably in the range of 50%–90%, and more preferably in the range of 70%–90%, of the width p, which is the width taken along the middle portion of the lacuna 3 as shown in FIG. 15(*a*). Although the width q would vary depending on the intended use of the shadow mask (such as for television, computer monitor, etc.) and also vary depending on the size of the shadow mask, the width q is generally formed in the range of 20 μm–70 μm.

As shown in FIG. 15(*b*), when the lacuna has such a shape as shown in FIG. 15(*a*) and described above, the protuberances 2, 2 in the pseudo-bridge 4 produces rectangular appearances on the CRT panel. Because the image produced on the CRT screen is rectangular, even when the electron beam shifts to some degree, the shift does not greatly influence the brightness of the image formed on the CRT screen.

In this embodiment of the invention, the width p does not have to be always measured through the midpoint of the total distance of the lacuna 3 taken along the Y-axis direction (i.e., the vertical direction in FIG. 15(*a*)). Instead, the width p may be a measurement in the X-direction (or horizontal direction in FIG. 15(*a*)) of the lacuna 3 that has the widest width. In other words, the shape of lacuna 3 is not particularly limited having the widest width formed at the midpoint of the total distance of the lacuna 3 along the Y-axis direction (i.e., the vertical direction in FIG. 15(*a*)) in order to produce rectangular images of FIG. 15(*b*) on the CRT panel.

Similarly, the width q does not always have to be measured at the edge parts of lacuna 3 as this is shown in FIG. 15(*a*). The width q may be measured at anywhere the width of the lacuna 3 is the narrowest. The shape of lacuna 3 is not particularly limited to having the narrowest widths at the ends that are connected to the upper and lower openings of the slot (as this is shown in FIG. 15(*a*)).

Further, the outline of the lacuna 3 is not limited specifically to being an arc. The side edge lines of protuberances that define the outline of a lacuna 3 may be straight lines or other curved lines.

When such lacunae are formed by etching in the process of manufacturing the shadow mask, it is desirable to use a photomask of diamond or elliptical shape. In this case, the position where the width p of the center is measured, namely, the position which shows the widest width in the lacuna, is the position where opposite vertices lie in the diamond shape of the photo mask.

With respect to the thickness of the steel sheet which is used for the shadow mask of this invention for the cathode-ray tube, a thickness within the range of generally used in this art may be adaptable. More specifically, a thickness of the steel sheet may be in the range of 80 μm to 150 μm.

The fifth embodiment can be utilized in combination with any of the other embodiments of the present invention, and particularly in combination with the first embodiment to bring a preferable result. Incidentally, as shown in FIG. 2(*b*), even when one of the end parts of the lacuna is narrower than the other end part of the lacuna, the effects similar to those of the aforementioned fifth embodiment can be expected as far as the width at the center of the lacuna is larger than at least the narrower end part of the lacuna.

In addition to the above-mentioned combinations, it is possible to utilize the embodiments of this invention in the form of any combination therebetween, and the combination may be a combination of any two embodiments, of any three embodiments, of any four embodiments, or of all embodiments.

This invention is not limited to the above-mentioned embodiments. The above-mentioned embodiments are adapted only for the purpose of illustrating this invention. Any of which have substantially the same construction as the technical thought described in the Claims has, and which can provide the same functions and effects are included in the technical range of this invention.

EXAMPLES

Now, the shadow mask according to this invention for the cathode-ray tube is described concretely by the examples.

Example 1

The Deviation in the Y-Axis Direction in the Pseudo-Bridge

Figure 7A:
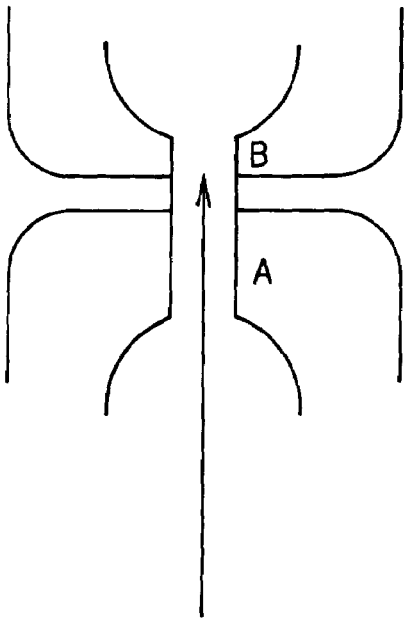
FIGS. 7(*a*)–7(*b*) are schematic views to illustrate the deviation in the Y-axis direction which was formed in Example 1, wherein (a) is a plan view and (b) a sectional view.
Figure 7B:
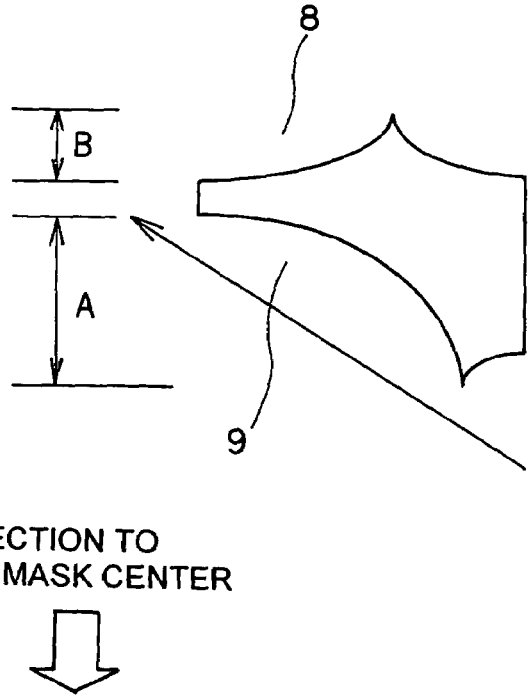
Figure 8:
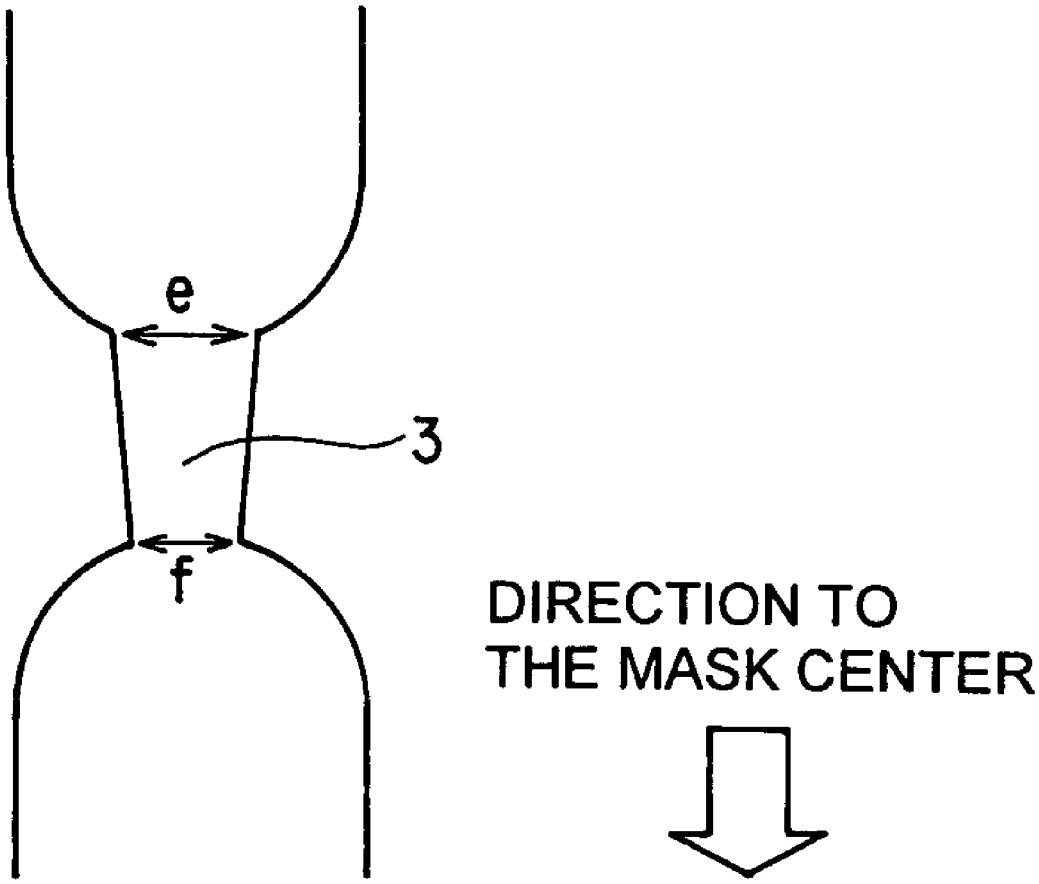
FIG. 8 is a schematic view to illustrate Example 2.

In the shadow mask for a 29-inches cathode-ray tube, the deviations in the Y-axis direction were formed at the location where the incident angle α of the electron beam in the Y-axis direction was 35° so that the width (A) of the inner etching part 9 was set as 71 μm, and the width (B) of the outer etching part as 20 μm (See FIG. 7.). Similarly, at the locations where the incident angle α was 15°, 25°, or 30°, the deviations in the Y-axis direction were formed. The width (A) of the inner etching part and the width (B) of the outer etching part in such locations are enumerated in the following Table 1. Incidentally, the thickness of the steel sheet in this case was 100 μm.

TABLE 1

| The Y-axial incident angle α of the electron beam (°) | The width A of the inside etching part (μm) | The width B of the outside etching part (μm) |
|---|---|---|
| 15 | 30 | 25 |
| 25 | 50 | 20 |
| 30 | 60 | 20 |
| 35 | 71 | 20 |

The cathode-ray tube which used this shadow mask was one with the good quality which did not show the degradation of the color purity by the diffused reflection of the electron beam.

Example 2

The Surface Shape in the Lacuna of the Pseudo-Bridge at the Electron Gun Side

When the lacunae 3 with a width of about 50 μm were planned at the location where the incident angle α of the electron beam in the Y-axis direction was 35°, cutting planes having few of prominences could be formed by setting the width e at the outer peripheral side edge on the steel plate surface in the electron gun side as 100 μm, and the mask center side edge f as 80 μm, and thus being slanted between them.

Example 3

Shielding of the Incident Beam at the Pseudo-Bridge (Y-Axis 1)

By using a steel plate of 100 μm in thickness, a shadow mask for the 29-inches cathode-ray tube were manufactured. At a pseudo-bridge which was formed at the location where the incident angle α of the electron beam in the Y-axis direction was 35°, t and β of the above mentioned relationship were determined. As a result, it was found that t1=60 μm, and β=40 μm.

These measurements satisfied the relationship:

$$\beta < t1 \times \tan \alpha.$$

Similarly, at a pseudo-bridge which was formed at the location where the incident angle α of the electron beam in the Y-axis direction was 30°, it was found that t and β of the above mentioned relationship were t1=60 μm, and β=30 βm as a result of measuring; and at the location where the incident angle α was 25°, it was found that t1=60 μm, and β=26 μm. These measurements also satisfied the above mentioned relationship.

Since the cathode-ray tube which used such a shadow mask satisfied the above relationship, the electron beam irradiated was shielded by the protuberances of pseudo-bridge, and thus, the visual obstacle where the normal bridges were emphasized and the horizontal black strips were observed could not observed at this cathode-ray tube.

Example 4

Shielding of the Incident Beam at the Pseudo-Bridge (Y-Axis 2)

A shadow mask which had normal bridges and pseudo-bridges the widths in the Y-axis direction of which are shown in FIG. 2 was manufactured.

TABLE 2

| Position | Width D1 of the regular bridge in the Y-axis direction (μm) | Width D2 of the pseudo-bridge in the Y-axis direction (μm) | The value of (D2 − D1) when D1 is 100% (%) |
|---|---|---|---|
| Y-axial center | 50 | 120 | 140 |
| 100 mm position from Y-axial center | 90 | 133 | 48 |
| 170 mm position from Y-axial center | 115 | 140 | 21 |

Since, in the cathode-ray tube which used the shadow mask thus manufactured, the passage amount of the electron beam at the pseudo-bridge was similar to that of the normal bridge, the visual obstacle where the normal bridges were emphasized and the horizontal black strips were observed could not observed at this cathode-ray tube.

Example 5

Shielding of the Incident Beam at the Pseudo-Bridge (X-Axis)

A tension type shadow mask was manufactured by forming slots which had pseudo-bridge in a steel plate by etching. The steel plate used was 130 μm in thickness, and the mask was formed so that the value γ shown in FIG. 13 was gradually increased as the position was off from the center to outside in the X-axial direction.

The values t2 and δ determined at the X-axial center, at 100 mm position from X-axial center in the X-axis direction, and at 210 mm position from X-axial center in the X-axis direction are enumerated in Table 3, together with the values γ and the values t2×tan γ.

TABLE 3

| Position | γ (°) | T2 (mm) | δ (mm) | t2 × tan γ |
|---|---|---|---|---|
| X-axial center | 0 | 70 | 40 | 0 |
| 100 mm position from X-axial center | 25 | 64 | 25 | 30 |
| 210 mm position from X-axial center | 40 | 60 | 22 | 50 |

As clear from Table 3, the shadow mask of this example was what met δ<t2×tan γ at the positions which left the X-axial center by equal to or more than 100 mm in the X-axis direction.

When installing this shadow mask in the cathode-ray tube, the problem such as the visual obstacle was not observed.

Example 6

Shadow Mask for TV

A shadow mask which had the pseudo-bridge of the shape as shown in FIG. 15(*a*) was manufactured. In order to form the lacuna of the pseudo-bridge, a photomask of the diamond shape was used. The width q at the end part of the lacuna was determined as 45 μm and the width p at the center was determined as 60 μm. In this case, the width q at the end part was 75% of the width p at the center.

At the cathode-ray tube for the TV which used such a shadow mask, protuberances of the pseudo-bridge observed on the panel were rectangular.

Example 7

Shadow Mask for Monitor

A shadow mask which had the pseudo-bridge of the shape as shown in FIG. 15(*a*) was manufactured. In order to form the lacuna of the pseudo-bridge, a photomask of the diamond shape was used, same as Example 6. The width q at the end part of the lacuna was determined as 20 μm and the width p at the center was determined as 30 μm. In this case, the width q at the end part was 67% of the width p at the center.

At the cathode-ray tube for monitor which used such a shadow mask, protuberances of the pseudo-bridge observed on the panel were rectangular.

INDUSTRIAL UTILITY

As mentioned above, in this invention, since the pseudo-bridges are provided with the deviation in the Y-axis direction, even at the outer peripheral side in the Y-axis direction of the shadow mask, the side being where the incidence angle of the electron beam becomes larger, the diffused reflection will not occur when the electron beam irradiates to the protuberance of the pseudo-bridge. Therefore, problems such as image turbulence which is caused by the diffused reflection of the electron beam can be prevented.

Further, in this invention, since the protuberances of the pseudo-bridge has a shape satisfying the relationship, $\beta < t1 \times \tan \alpha$, the electron beam passing through the protuberance of the pseudo-bridge is obstructed around the outer peripheral edge of the inside etching part in the Y-axis direction. Thus, it is possible to decrease the quantity of electron beam passed through the pseudo-bridge, and the visual obstacle where the normal bridges are emphasized and the horizontal black strips are observed can be sufficiently prevented.

Further more, in this invention, since the pseudo-bridge is made the shape which satisfies the relationship, $\delta < t2 \times \tan \gamma$, the electron beam passing through the lacuna of the pseudo-bridge is obstructed at the edge of the side opposite to the mask center in the etching part on the mask surface. Thus, it is possible to decrease the quantity of electron beam passed through the lacuna of the pseudo-bridge, and a shadow which has a similar level with that of the regular bridge can be can be reflected onto the panel. The problem that the position of the regular bridge is taken by the naked eye as the line on the screen as a visual obstacle can be prevented.

Still further, in this invention, since the shape of the lacuna is prepared so that the width of the lacuna at the middle part of the lacuna is wider than that at end part of the lacuna, the shadow of the protuberance of the pseudo-bridge can be an almost rectangular appearance on the panel, and thus, the possibility of the brightness change on the somewhat shifting of electron beam can be expelled considerably.

The invention claimed is:

1. A slot tension-type shadow mask for a cathode-ray tube (CRT) having a screen, comprising a slot comprising a pseudo-bridge, wherein the pseudo-bridge separates first and second openings of the slot, the openings being arranged in the direction of the tension being applied (which is referred to as the Y-axis direction) such that the first opening is positioned closer to the center of the CRT screen than the second opening, wherein the pseudo-bridge consists of a pair of protuberances that are separated by a lacuna between the two protuberances to connect the first and second openings of the slot, wherein the protuberances extend in the direction substantially perpendicular to the Y-axis direction (which is referred to as the X-axis direction), wherein each protuberance extending in the X-axis direction touches the CRT screen and having at least three portions:

a first etched portion at the edge of the first opening but not touching the CRT screen;

a second etched portion at the edge of the second opening but not touching the CRT screen; and a third etched portion at the edge of the lacuna but not touching the CRT screen, and wherein the first, second, and third etched portions of each protuberance are shaped in the Z-axis direction (which is substantially perpendicular to Y-axis and X-axis directions) to a predetermined depth so as not to touch the CRT screen, and the shape of the protuberance edge formed in the Z-axis direction to a predetermined depth is referred to as a deviation, and wherein the distance of the first etched portion along the Y-axis direction is longer than the distance of the second etched portion along the Y-axis direction.

2. The slot tension type shadow mask of claim 1, wherein the distance between the edges of the first and second protuberances forming the lacuna and connected to one of the openings positioned closer to the center of the CRT screen is 10%–100% wider when the distance between the other edges of the first and second protuberances connected to the other opening positioned farther from the center of the CRT screen.

3. The slot tension type shadow mask of claim 1, wherein the lacuna has a shape where the width of the lacuna at the middle is wider than the width of the lacuna at either end of the lacuna connecting either the first or second opening.

4. The slot tension type shadow mask of claim 1, wherein the lacuna has a shape where the width of the lacuna at the middle is wider than the width of the lacuna at either end of the lacuna connecting either the first or second opening.

5. Shadow mask for the cathode-ray tube according to claim 4, wherein a mean value width of the pseudo-bridge in the Y-axis direction is wider than a mean value width of the normal bridge in the Y-axis direction at a rate of 20%–150%, wherein the mean value width is a mean value of the widest and narrowest widths of the protuberance measured in the Y-axis direction.

6. A slot tension-type shadow mask for a cathode-ray tube (CRT) having a screen, comprising a slot comprising a pseudo-bridge, wherein the pseudo bride separates first and second openings of the slot, the openings being arranged in the direction of the tension being applied (which is referred to as the Y-axis direction) such that the first opening is positioned closer to the center of the CRT screen than the second opening;

wherein the pseudo-bridge consists of a pair of protuberances that are separated by a lacuna between them, wherein the protuberances extend in the direction substantially perpendicular to the Y-axis direction (which is referred to as the X-axis direction), wherein each protuberance extending in the X-axis direction touches the CRT screen and having at least three portions:

a first etched portion at the edge of the first opening but not touching the CRT screen;

a second etched portion at the edge of the second opening but not touching the CRT screen; and a third etched portion at the edge of the lacuna but not touching the CRT screen, and wherein the second etched portion is etched in the Z-axis direction (which is substantially perpendicular to the X and Y axes directions) to have the shape satisfying the relationship:

$$\delta < t2 \times \tan \gamma$$

wherein $\delta$ is the distance measured in the X-axis direction of the second etched portion of the protuberance located farther away from the center of the CRT screen than the other protuberance, wherein t2 is the etching thickness in the Z-axis direction of the second etched portion having the distance $\delta$, and wherein $\gamma$ is the incidence angle of the electron beam to the second etched portion of the pseudo-bridge, wherein the incidence angle $\gamma$ is the angle of the electron beam measured with reference to the X-axis and Z-axis.

7. The slot tension type shadow mask of claim 6, wherein the $\gamma$ is not less than 10°.

8. A slot tension-type shadow mask for a cathode-ray tube having a screen, comprising a slot comprising a pseudo-bridge, wherein the pseudo-bride separates first and second openings of the slot, the openings being arranged in the direction of the tension being applied (which is referred to as the Y-axis direction), wherein the pseudo-bridge consists of a pair of protuberances that are separated by a lacuna between them, wherein the protuberances extend in the direction substantially perpendicular to the Y-axis direction (which is referred to as the X-axis direction) such that the plane formed by the X and Y axes is away from the CRT electron gun in the Z-axis direction that is substantially perpendicular to the X and Y axes directions; and wherein the lacuna has a shape where the width of the lacuna at the middle part of the lacuna is wider than that at either end part of the lacuna.

9. The slot tension type shadow mask of claim 8, wherein the width of the lacuna at the end part is a 50%–90% width when compared to the width of the lacuna at the middle part.

10. The slot tension type shadow mask of claim 8 or 9, wherein the lacunae are formed using a photomask of diamond or elliptical shape.

* * * * *